US007734054B2

(12) United States Patent
Asada

(10) Patent No.: US 7,734,054 B2
(45) Date of Patent: Jun. 8, 2010

(54) ACOUSTIC APPARATUS, CONNECTION POLARITY DETERMINATION METHOD, AND RECORDING MEDIUM

(75) Inventor: Kohei Asada, Kanagawa (JP)

(73) Assignee: Sony Corporation (JP)

( * ) Notice: Subject to any disclaimer, the term of this patent is extended or adjusted under 35 U.S.C. 154(b) by 1085 days.

(21) Appl. No.: 11/406,698

(22) Filed: Apr. 19, 2006

(65) Prior Publication Data

US 2006/0262940 A1 Nov. 23, 2006

(30) Foreign Application Priority Data

Apr. 19, 2005 (JP) ..... P2005-120840

(51) Int. Cl.
*H04R 29/00* (2006.01)
*H04R 3/00* (2006.01)

(52) U.S. Cl. ..... 381/58; 381/59; 381/96

(58) Field of Classification Search ..... 381/56, 381/58, 59, 95, 96, 103
See application file for complete search history.

(56) References Cited

U.S. PATENT DOCUMENTS 3,067,297 A * 12/1962 Fink ..... 381/1
4,908,868 A * 3/1990 McTaggart ..... 381/59
5,319,714 A * 6/1994 McTaggart ..... 381/59
5,568,559 A * 10/1996 Makino ..... 381/98
5,581,621 A * 12/1996 Koyama et al. ..... 381/103
6,681,019 B1 * 1/2004 Kitano et al. ..... 381/59
6,970,568 B1 * 11/2005 Freeman et al. ..... 381/58
7,630,501 B2 * 12/2009 Blank et al. ..... 381/58
2006/0050891 A1 3/2006 Bharitkar
2006/0062399 A1 3/2006 McKee Cooper et al.

FOREIGN PATENT DOCUMENTS

EP 0687126 12/1995
JP 59-012367 A 1/1984
JP 10248097 A 9/1998
JP 10248098 A 9/1998
JP 2000102089 A 4/2000
JP 2003-322559 A 11/2003
JP 2004013367 A 1/2004
JP 2004-297368 A 10/2004

OTHER PUBLICATIONS

Joseph Appolito: "Testing Loudspeakers" Audio Amateur Press, 1998, p. 126-127.

* cited by examiner

*Primary Examiner*—Xu Mei
(74) *Attorney, Agent, or Firm*—Lerner, David, Littenberg, Krumholz & Mentlik, LLP

(57) ABSTRACT

An acoustic apparatus includes an obtaining section configured to obtain impulse response data between at least one speaker and a microphone; a computation section configured to compute step response data by integrating the impulse response data obtained by the obtaining section; and a determination section configured to determine a connection polarity of the speaker in accordance with the size relationship of areas of a region on the positive side and a region on the negative side of the step response data in a determination segment of a predetermined time width in which a rise point of the step response is a starting point.

8 Claims, 9 Drawing Sheets

ACOUSTIC APPARATUS, CONNECTION POLARITY DETERMINATION METHOD, AND RECORDING MEDIUM

CROSS-REFERENCE TO RELATED APPLICATIONS

The present application claims priority from Japanese Patent Application No. JP 2005-120840 filed on Apr. 19, 2005, the disclosure of which is hereby incorporated by reference herein.

BACKGROUND OF THE INVENTION

The present invention relates to an acoustic apparatus such as a stereo acoustic system and a multi-channel acoustic system, to a method for determining a connection polarity of a speaker used in the acoustic apparatus, and to a recording medium having recorded thereon a program.

In content such as movies recorded on a DVD (Digital Versatile Disc) and in digital television broadcast, so-called multi-channel audio data, such as a 5.1 channel and a 7.1 channel, has come to be handled, and the number of chances of setting a multi-channel listening system, such as a 5.1 channel and a 7.1 channel, has increased.

For example, a listening system of a 5.1 channel is formed of six audio channels: a front left channel, a front center channel, a front right channel, a back left channel, a back right channel, and a subwoofer channel, and can play back audio by using six speakers corresponding to the six audio channels. The expression [0.1] in the 5.1 channel means a subwoofer channel compensating for low frequency components.

In a multi-channel listening system, at present, in a connection between at least one speaker and an amplifier section, two speaker cables, that is, + (positive) and − (negative) speaker cables, need to be connected to the + (positive) and − (negative) connection terminals of the amplifier unless a specifically dedicated socket section is provided; In this case, there are cases in which a user performs setting of polarities by mistake.

In this specification, the polarity related to the connection between an amplifier section and a speaker is referred to as a "connection polarity". A case where a positive connection terminal and a positive cable are connected to each other, and a negative connection terminal and a negative cable are connected to each other, is referred to as a "positive connection (positive phase connection)". In contrast to the above, a case where a positive connection terminal and a negative cable are connected to each other, and a negative connection terminal and a positive cable are connected to each other, is referred to as a "negative connection (reverse connection or reverse phase connection).

Some listening systems are designed to automatically detect a connection mistake of a speaker. For example, a measurement system capable of a determining a polarity related to the connection of a speaker shown in FIG. 8 (determining a connection polarity of a speaker) has been proposed. The measurement system shown in FIG. 8 allows a digital amplifier 102 to perform DAC (Digital-Analog Convert) playback of a signal for measuring a time-stretched pulse (TSP) (signal in which the energy of an impulse signal is distributed in a time axis), which is generated in a TSP signal generation section 101, and allows this signal to be emitted from a target speaker among speakers SP1 to SP5.

The TSP measurement signal emitted in this manner is collected by a microphone MC determined so as to be arranged, for example, at a position of 1 m in front in the tweeter axis of the target speaker. The TSP measurement signal is amplified and converted into a digital signal by a microphone amplifier+ADC (Analog-Digital Converter) 103. This signal is analyzed by a signal analysis section 104 in order to determine an impulse response. On the basis of a sign (+ (positive) or − (negative)) of the value of a rise point of a time waveform of the impulse response, the connection polarity of the speaker is determined.

As described above, a connection mistake of the speaker is detected, and the result is reported to the user so that, in the case of a connection mistake, a prompt for remaking the connection of that speaker can be made. As a result, also, in a multi-channel listening system, polarities of a speaker can be correctly connected to predetermined terminals of a digital amplifier, and a satisfactory audio listening environment can be arranged.

A technology used for emitting test sound from a speaker, for collecting this sound by a microphone arranged at a predetermined position, and for obtaining an impulse response as in the above-described listening system has been widely used to perform so-called time alignment in, for example, acoustic processing apparatuses disclosed in Japanese Unexamined Patent Application Publication Nos. 10-248097 and 10-248098 (to be described later). As a technology related to a polarity determination of a speaker, as disclosed in Japanese Unexamined Patent Application Publication No. 2000-102089, there is known a technology in which a user can perform determination of the polarity of the speaker on the basis of a difference in the sound localization of sound.

As is also described above, in a measurement system of the related art capable of making a determination as to the connection polarity of the speaker shown in FIG. 8, on the basis of the polarity (positive/negative) of the waveform of the rise of an impulse response, the determination of the connection polarity of the connected speaker is performed. However, in this case, the following problems may occur.

More specifically, a case in which a plurality of speaker units (devices) are installed in one speaker system and polarities of each unit inside the speaker system (internal unit polarities) are not aligned becomes a problem. In this case, the polarity of the rise may differ depending on the measurement point (the geometrical position of the microphone setting) of an impulse response, and the problem of incapable of performing an accurate polarity determination arises.

As one speaker system in which a plurality of speaker units are installed, there is a so-called 2-way type formed of a so-called woofer and a so-called tweeter. In terms of this 2-way type, when importance is given on the characteristics of coupling (cross-over) at the frequencies of the woofer and the tweeter, speaker units may be installed inside the speaker system (inside the housing) in a state in which the polarities of the two units are changed by a filter design and the phases are inverted.

In this specification, a speaker (device) of a single body, such as a woofer and a tweeter, is referred to as a "speaker unit", and one or more speaker units installed inside one housing are referred to as a "speaker system" or simply as a "speaker".

FIG. 9 shows examples of each impulse response when the position of a microphone MC is changed by using a speaker system SP in which the "internal unit polarity" of the woofer is in a positive phase connection (positive connection) and the "internal unit polarity" of the tweeter is in a reverse phase connection (reverse connection). When the "internal unit polarity" is in a positive phase connection, when a positive signal is input, the vibration plate of the speaker unit moves toward the front. When the "internal unit polarity" is in a reverse phase connection, when a positive signal is input, the vibration plate of the speaker unit moves toward the back.

As shown in part B of FIG. 9, when characteristics measurement and analysis are performed in such a manner that the microphone MC is arranged at a position nearly equal from the tweeter and the woofer and toward the front facing the sound emitting face of a speaker system SP, and an impulse signal (impulse sound) emitted from the speaker system SP is collected, an impulse response shown in a response waveform chart in part B of FIG. 9 is observed.

The impulse response of the speaker system SP may be considered as the addition of the two individual impulse responses of the woofer and the tweeter (including a network circuit). In general, since the energy of the woofer part is larger than that of the tweeter, the rise point of the impulse response waveform is in a positive direction. In the case of, for example, an ordinary listening environment, in particular, regarding the front speaker, the speaker unit is made to usually match the height at approximately the ear position of a listener, and the sign of the rise point of the impulse response near the speaker axis can be considered as the "connection polarity" of the speaker system.

However, when characteristics measurement and analysis of the speaker system are to be performed, if the position of the microphone with respect to the speaker system is strictly determined, only preparing a state in which characteristics of the speaker system can be measured accurately is hard. It is preferable that, if possible, the position of the microphone with respect to the speaker system has a degree of freedom so that it can be installed at a free position.

When the microphone is to be installed to measure and analyze the characteristics of the speaker system, when it is considered that a user can install it at a desired position and at a convenient position, the microphone is not necessarily installed toward the front in the speaker axis, as shown in part B of FIG. 9. For example, as shown in part A of FIG. 9, there is a case in which the microphone MC is installed at a position higher than the speaker system SP in such a manner as to be offset from the speaker axis, and also, as shown in part C of FIG. 9, there is a case in which the microphone MC is installed at a position lower than the speaker system SP.

Then, as shown in part A of FIG. 9, when the microphone MC is installed at a position higher than the speaker system SP, the tweeter becomes closer to the microphone MC when compared to the woofer. Furthermore, as shown in part C of FIG. 9, when the microphone MC is installed at a position lower than the speaker system SP, the woofer becomes closer to the microphone MC when compared to the tweeter.

In the case of the example shown in FIG. 9, each unit of the woofer and the tweeter is mounted side by side in the height direction of the speaker system SP. Therefore, in the case of examples shown in parts A and C of FIG. 9, the difference between the arrival times of the impulse signals from each unit becomes clear, and as shown in the response waveform of parts A and C of FIG. 9, an impulse response with respect to each unit appears clearly.

Then, as shown in part C of FIG. 9, when the position of the microphone MC is close to the unit (woofer in this case) that is in a positive phase connection inside the speaker SP, the connection polarity matches the rise polarity of the impulse response. However, the problem is a case shown in part A of FIG. 9. Even when the speaker connection of the user is correct, since the impulse signal emitted from the tweeter in which the internal unit polarity is in a reverse phase connection arrives the microphone MC earlier, it could be determined as being "reversely connected".

This fact poses a serious problem due to the following reasons. In the listening system for a multi-channel, regarding, in particular, a small surround speaker, a case in which a microphone is installed in a wall or on a ceiling in a portion higher than the ear of the listener, and a case in which a microphone is installed on a floor due to the environment of the installation place can actually occur. Therefore, depending on the position of the microphone with respect to the speaker system, it is difficult to accurately make a determination as to whether or not the connection polarity of the speaker is correct on the basis of the determination of only the polarity of the rise of the impulse response.

In view of the above, it is desirable to reliably and quickly make a determination as to the connection polarity of a speaker without limiting the installation position of a microphone with respect to a speaker system.

SUMMARY OF THE INVENTION

According to an embodiment of the present invention, there is provided an acoustic apparatus including obtaining means for obtaining impulse response data between at least one speaker and a microphone; computation means for computing step response data by integrating the impulse response data obtained by the obtaining means; and determination means for determining a connection polarity of the speaker in accordance with the size relationship of areas of a region on the positive side and a region on the negative side of the step response data in a determination segment of a predetermined time width in which a rise point of the step response is a starting point.

In the acoustic apparatus according to an embodiment of the present invention, impulse response data between at least one speaker and a microphone may be obtained. Then, step response data may be computed by the computation means on the basis of the obtained impulse response data.

Then, in the determination means, an area of a region on a negative side and an area of a region on a positive side of a waveform of the step response data in a predetermined determination segment in which a rise point of a step response is a starting point may be determined, and the connection polarity of the speaker may be determined on the basis of the size of the target area.

As described above, step response data obtained by integrating impulse response data corresponds to the magnitude of energy in each time of the impulse response. The area on the positive side, of the areas surrounded by the horizontal axis (reference axis) and the waveform of step response data, corresponds to the energy on the positive side of the impulse response. The area on the negative side corresponds to the energy on the negative side of the impulse response. Therefore, the size of this area makes it possible to reliably and quickly make a determination as to whether or not the speaker is connected to the positive polarity or is connected to the reverse polarity without limiting the installation position of the microphone with respect to the speaker.

DETAILED DESCRIPTION

Figure 1:
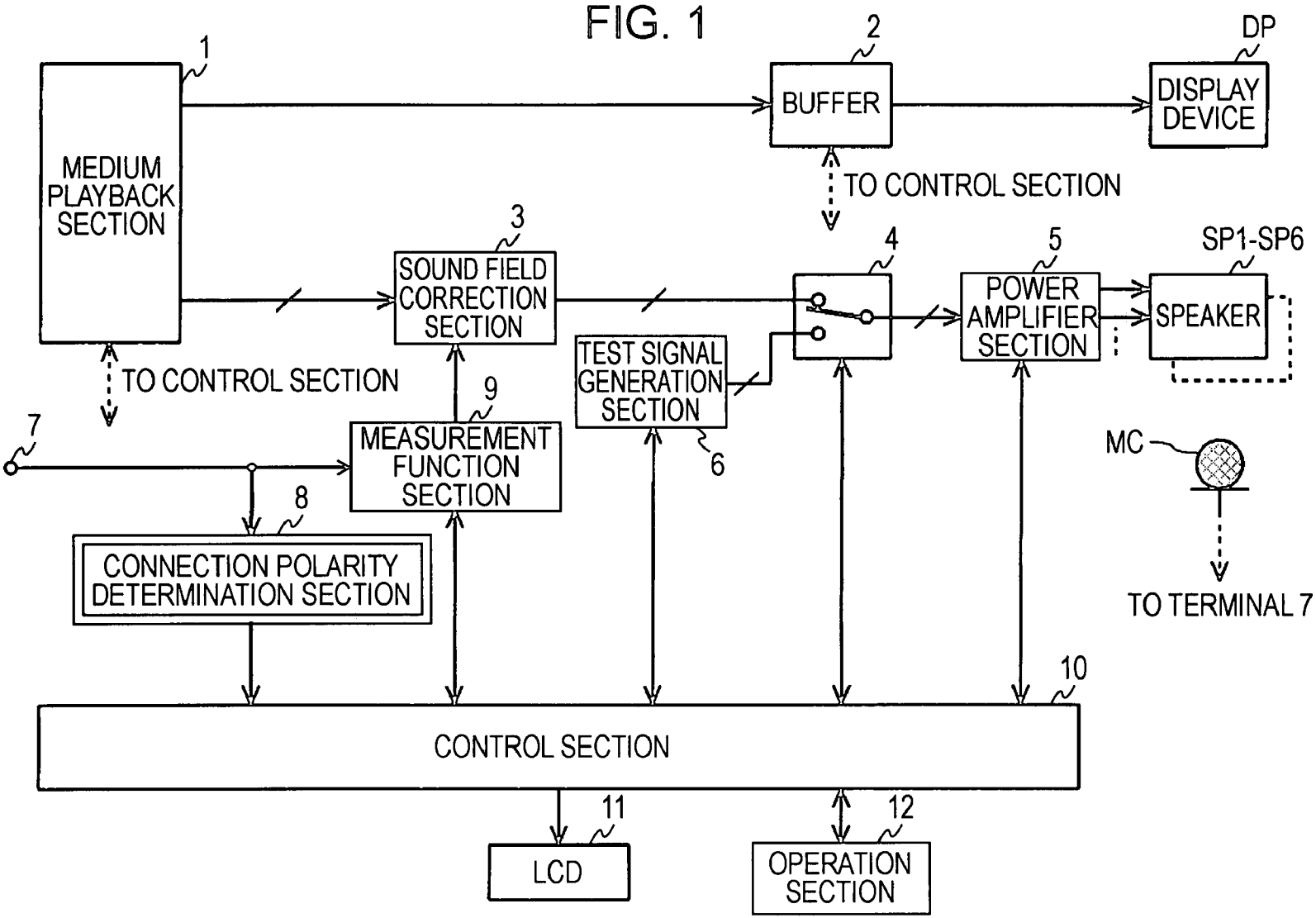
FIG. 1 is a block diagram illustrating a playback apparatus to which an embodiment of the present invention is applied.

With reference to the drawing, a description will now be given of an acoustic apparatus, a connection polarity determination method, and a recording medium according to embodiments of the present invention. In the embodiments to be described below, a description will be given by using as an example a case in which the present invention is applied to a playback apparatus capable of playing back a multi-channel audio signal recorded on an optical disc recording medium (hereinafter referred to simply as an "optical disc"), such as a DVD (Digital Versatile Disc).

[Configuration and Basic Operation of Playback Apparatus]

FIG. 1 is a block diagram illustrating a playback apparatus of this embodiment. The playback apparatus of this embodiment can play back, for example, a multi-channel audio signal of a 5.1 channel. As shown in FIG. 1, the playback apparatus of this embodiment includes a medium playback section 1, a frame buffer 2, a sound field correction section 3, a switch circuit 4, a power amplifier section 5, a test signal generation section 6, a connection terminal 7 of a microphone, a connection polarity determination section 8, and a measurement function determination section 9, a control section 10, an LCD (Liquid Crystal Display) 11, and an operation section 12.

As shown in FIG. 1, for example, a display device DP is connected to the playback apparatus of this embodiment via the frame buffer 2, and six speaker systems SP1 to SP6 are connected thereto via the power amplifier section 5 in such a manner as to correspond to each 5.1 channel. Furthermore, a microphone MC is connected to the connection terminal 7 of the microphone.

In each of the speaker systems SP1 to SP6, one or more speaker units are incorporated. Therefore, in each of the speaker systems SP1 to SP6, only one speaker unit may be incorporated. However, in this embodiment, a description is given by assuming that, in each of the speaker systems SP1 to SP6, two speaker units of a woofer and a tweeter are incorporated. In the following, the speaker systems SP1 to SP6 will be referred to simply as "speakers SP1 to SP6".

The control section 10 controls each section of the playback apparatus of this embodiment. Although not shown, the control section 10 is configured as a microcomputer including a CPU (Central Processing Unit), and non-volatile memories, such as a ROM (Read Only Memory), a RAM (Random Access Memory), and an EEPROM (Electrically Erasable and Programmable ROM).

As is also shown in FIG. 1, the LCD 11 and the operation section 12 are connected to the control section 10. The LCD 11 has a comparatively large display screen, and can display various kinds of information, such as a guidance message, a warning message, and a status display, on the basis of information from the control section 10.

The operation section 12 includes an on/off key of the power source, a playback key, a pause key, a fast-forward key, a fast-rewind key, and other various kinds of operation keys. The operation section 12 accepts an operation input from a user, converts this input into an electrical signal, and supplies this signal to the control section 10. As a result, the control section 10 can control each section on the basis of an operation input from the user.

Although not shown, the medium playback section 1 includes a loading section for an optical disc such as a DVD; a rotational driving section for an optical disc, having a spindle motor or the like; an optical pickup section having an optical system, such as a laser light source, an objective lens, a 2-axis actuator, a beam splitter, a photo detector or the like; a sled motor for moving the optical pickup section in the radial direction of the optical disc; and various kinds of servo circuits, and also includes a video decoder and an audio decoder.

When a playback instruction is accepted via the operation section 12, the control section 10 controls each section, so that a process for playing back content recorded on an optical disc loaded into the medium playback section 1 is started. It is assumed here that the medium loaded into the medium playback section 1 is a DVD and that content recorded thereon is content of a movie formed of audio data and video data of a 5.1 channel.

In this case, under the control from the control section 10, the medium playback section 1 rotationally drives the loaded DVD, reads control data, audio data, video data or the like, which are recorded on the DVD, by radiating laser optical onto the DVD and by receiving the reflected light, and separates various kinds of these pieces of data. The control data within the separated data is supplied to the control section 10 so that the control data can be used to control each section.

Both the separated audio data and the video data are subjected to data compression and are recorded on a DVD. Therefore, the medium playback section 1 performs a decoding process on the read audio data and the video data in order to reconstruct the audio data and the video data before data compression. The reconstructed video data is supplied to the display device DP via the frame buffer 2.

The frame buffer 2 is such that writing/reading of video data is controlled by the control section 10, and is used to temporarily store video data in frame units in order to overcome deviation of so-called rip sync. That is, as will be described later, processing takes time because a sound field correction process or the like is performed on audio data, and a time lag occurs between the playback of the audio data and the playback of the video data. Therefore, in order to overcome this time lag, the frame buffer 2 is provided, so that the playback timing of the video data is synchronized with the playback timing of the audio data, and thus deviation of a rip sync does not occur.

The display device DP includes, for example, a display element having a comparatively large screen, such as an LCD, a PDP (Plasma Display Panel), an organic EL (Electro Luminescence) display, and a CRT (Cathode-Ray Tube). The display device DP forms an analog video signal for display from the video data supplied via the frame buffer 2, and allows the display screen of its own display element to display a video on the basis of this analog video signal.

As a result, the video based on the video data that is played back by the medium playback section 1 is displayed on the display screen of the display element of the display device DP, so that the user can observe (view) this video.

On the other hand, in the medium playback section 1, the audio data that is separated and decoded is further separated into audio data of each audio channel of a 5.1 channel. The audio data of each audio channel is supplied to the sound field correction section 3. The sound field correction section 3 can individually perform processing on each audio data of each audio channel of the 5.1 channel from the medium playback section 1, and includes a delay processing section, a sound quality adjustment section, and a gain adjustment section in such a manner as to correspond to each audio channel.

The sound field correction section 3 is designed to be able to form a correct sound field when a delay process, a sound quality adjustment process, a gain adjustment process, etc., are performed on the audio data of each audio channel, which is supplied to the sound field correction section 3, on the basis of an instruction parameter from the measurement function section 8 (to be described later) and audio based on the audio data is emitted from each of the speakers SP1 to SP6 (to be described later).

The audio data of each audio channel, which is processed in the sound field correction section 2, is supplied to the power amplifier section 5 via the switch circuit 4. Each of the switch circuit 4 and the power amplifier section 5 can also deal with the audio data of a 5.1 channel. That is, during the playback process, the switch circuit 4 is switched to the sound field correction section 3 side under the control of the control section 10, and supplies the audio data of each audio channel from the sound field correction section 3 to the power amplifier section 5 at a subsequent stage.

The power amplifier section 5 also includes an amplification processing section corresponding to each audio channel, converts the audio data of each audio channel into an analog audio signal under the control of the control section 10, amplifies the level of the analog audio signal to an indicated level, and thereafter supplies the analog audio signal to the corresponding speakers SP1 to SP6.

As a result, audio based on the audio data of each audio channel, which is played back by the medium playback section 1, is emitted from the corresponding speaker among the speakers SP1 to SP6, and the user can listen to this audio.

In a multi-channel acoustic system as in the playback apparatus of this embodiment, when any one of the speakers is connected to a power amplifier with the connection polarity being mistaken, there are cases in which it is difficult to form a normal sound field. That is, when a speaker to be positively connected to the power amplifier is negatively connected, the movement (vibration) of the cone of the target speaker becomes reverse to that when the signal is positively connected. Therefore, the energy applied to the sound field becomes not normal in relation to another speaker, and it is difficult to form a normal sound field.

Furthermore, in the multi-channel acoustic system, there are cases in which it is difficult to form a satisfactory sound field as a result of being affected by the relationship between the installation position of each of a plurality of speakers and a listening position at which the user listens to audio emitted from each speaker, by the presence or absence of obstacles that obstruct the propagation of audio, and by differences in acoustic characteristics of the plurality of speakers.

That is, in the playback apparatus of this embodiment, a time difference occurs between speakers in the sound that arrives at the listening position from each of the speakers SP1 to SP6, and a difference occurs in sound quality and sound volume (level) between speakers that should correspond to each other. As a result, audio emitted from each of the speakers SP1 to SP6 is listened to individually and independently. Therefore, there are cases in which it is difficult to form an intended satisfactory sound field.

For this reason, in the playback apparatus of this embodiment, when a connection polarity determination process and sound field correction are instructed to be performed via the operation section 12, the control section 10 controls the test signal generation section 6, the connection polarity determination section 8, and the measurement function section 9 so that sound field correction and a connection polarity determination process are performed.

That is, audio in accordance with a predetermined measuring signal, such as a TSP measurement signal, which is generated as a test signal in the test signal generation section 6, is emitted from each of the speakers SP1 to SP6, and this audio is collected by the microphone MC and is supplied to the connection polarity determination section 8 and the measurement function section 9. Then, in the connection polarity determination section 8, collected audio (microphone output signal) supplied thereto is analyzed to determine the connection polarity of the speaker. In the measurement function section 9, the collected audio (microphone output signal) supplied thereto is analyzed to form a parameter for sound field correction, and this audio is supplied to the sound field correction section 3.

Although details will be described later, the connection polarity determination section 8 of the playback apparatus of this embodiment can accurately and quickly determine the connection polarity of each speaker without depending on the position of the microphone MC with respect to each of the speakers SP1 to SP6. That is, the connection polarity of the speaker is determined by using a method differing from the method of the related art in which the connection polarity of the speaker is determined by the polarity of the rise of the impulse response.

The determination result of the connection polarity of the speaker in the connection polarity determination section 8 is reported to the control section 10, and the control section 10 displays the determination result on the display screen of the LCD 11 and reports it to the user. As a result, it is possible for the user to clearly specify a speaker that is connected to a reverse polarity and to quickly correct a connection mistake.

The measurement function section 9 obtains information, such as the time difference of sound that arrives at the listening position in each audio channel (each speaker), and the sound quality and the level when the audio of each audio channel arrives at the listening position, by analyzing a test signal emitted from each of the speakers SP1 to SP6, forms each parameter, such as delay time, sound quality adjustment information, and a level adjustment information, with respect to the audio signal of each audio channel, and supplies this parameter to the sound field correction section 3.

As is also described above, the sound field correction section 3 is configured to include a delay processing section, a sound quality adjustment section, and a gain adjustment section for each audio channel. The sound field correction section 3 sets, into the processing section, each parameter for the delay time, the sound quality adjustment information, and the level adjustment information with respect to each audio channel from the measurement function section 9, and performs a delaying process, sound quality adjustment, and gain adjustment on the audio of each audio channel.

As described above, as a result of typically accurately and quickly making a determination as to the connection polarity of each speaker regardless of the position of the microphone MC, when the connection polarity is reverse (when the speaker is reversely connected), this fact is reported to the user, so that the connection of the speaker can be remade with respect to the power amplifier 5. Furthermore, a correct sound field corresponding to the listening position can be formed by the functions of the measurement function section 9 and the sound field correction section 3.

[Configuration and Operation of the Connection Polarity Determination Section]

Figure 9:
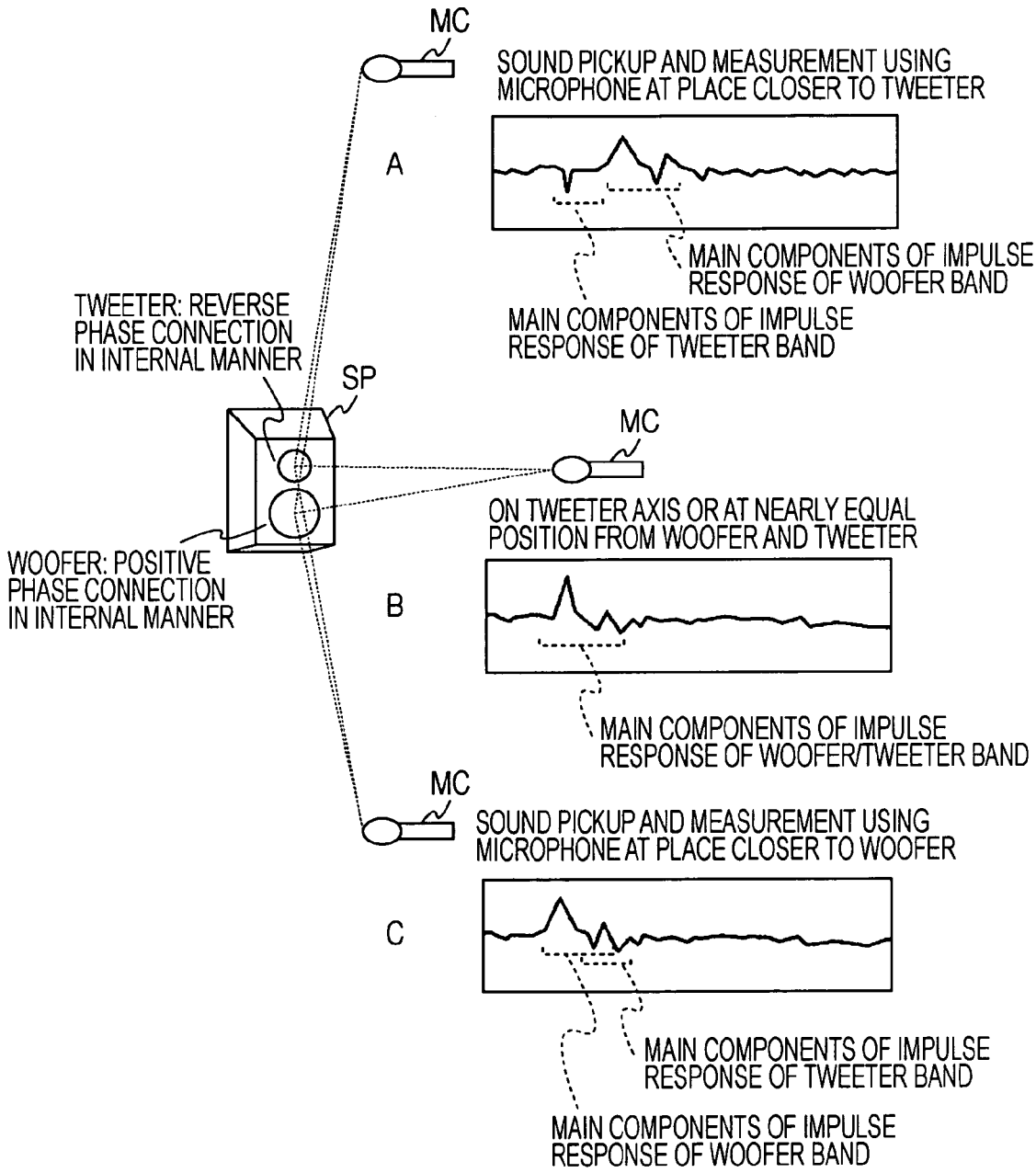
FIG. 9 shows an example of an impulse response that changes on the basis of the position of a microphone when a 2-way speaker is used.

As described with reference to FIG. 9, in the case of the method of the related art in which the connection polarity of the speaker is determined by the polarity of the rise of an impulse response, the polarity determination depends on the positional relationship of the speaker for which a determination is made as to the connection polarity and the microphone for collecting a test signal emitted from the target speaker. For this reason, if the method of the related art for determining the connection polarity of the speaker by the polarity of the rise of an impulse response is used, the position of the microphone may need to be changed and the sound collection direction may need to be adjusted for each speaker for which a determination is to be made as to the connection polarity.

However, for sound field correction, such as so-called time alignment performed by causing the sound field correction section 3 to function, at a listening position at which the user listens to the audio emitted from each speaker, the test signal emitted from each speaker may need to be collected. If, in addition to sound field correction, a determination is to be made as to the connection polarity of each speaker, it takes time and effort to only adjust the position and the sound collection direction of the microphone. In consequence, it is not possible to accurately and quickly make a determination as to the connection polarity.

For this reason, without depending on the position of the microphone for collecting a test signal emitted from the speaker, for example, even when the microphone is kept to be installed at a listening position selected by the user, it is desired that, on the basis of the test signal from each speaker, which is collected by the target microphone, the connection polarity of each speaker can be accurately and quickly determined.

Therefore, the connection polarity determination section 8 of the playback apparatus of this embodiment can accurately and quickly determine the connection polarity of each of the speakers SP1 to SP6 by analyzing a test signal that is emitted from each of the speakers SP1 to SP6 and that is collected by the target microphone MC even if the microphone MC is at any position with respect to each of the speakers SP1 to SP6.

The determination as to each connection polarity of each of the speakers SP1 to SP6 in the playback apparatus of this embodiment is described by using as an example a case in which an impulse signal, which is a test signal, is sequentially emitted from each of the speakers SP1 to SP6, and the determination is performed for each of the speakers SP1 to SP6. Furthermore, it is assumed that the microphone MC is installed at a listening position selected by the user and is not moved or does not change its direction.

Figure 2:
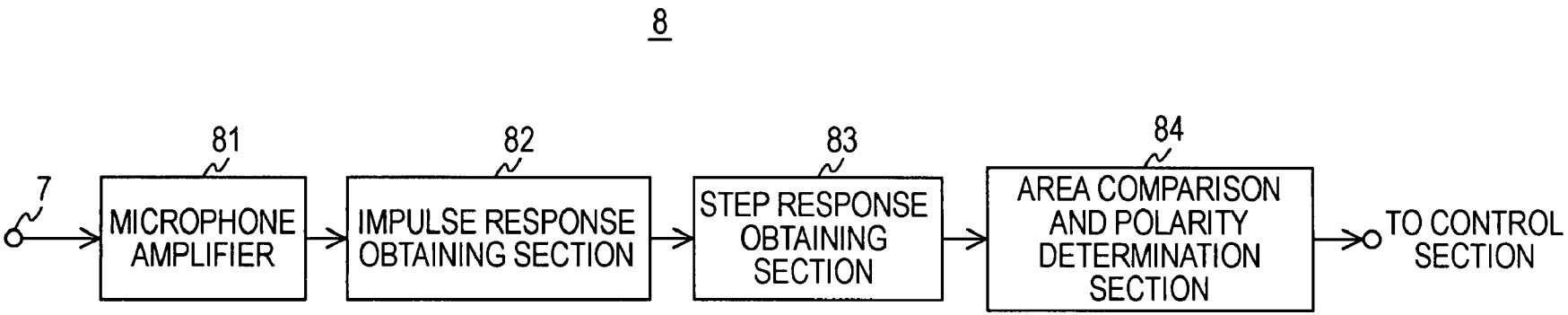
FIG. 2 is a block diagram illustrating a connection polarity determination section 8 of the playback apparatus shown in FIG. 1.

FIG. 2 is a block diagram illustrating the configuration of the connection polarity determination section 6 of the playback apparatus of this embodiment. As shown in FIG. 2, the connection polarity determination section 8 of the playback apparatus of this embodiment includes a microphone amplifier 81, an impulse response obtaining section 82, a step response obtaining section 83, and an area comparison polarity and determination section 84.

As is also described above, when the control section 10 accepts an input of an instruction, from the user via the operation section 12, that a connection polarity determination process for each of the speakers SP1 to SP6 be performed, the control section 10 switches the switch circuit 4 to the test signal generation section 6 side. Then, the control section 10 controls the test signal generation section 6 so as to sequentially generate a test signal, such as a TSP signal, for each audio channel corresponding to each of the speakers SP1 to SP6, supplies this test signal to a corresponding speaker via the target audio channel and the power amplifier 5, whereby audio is emitted in such a manner as to correspond to the target signal. In the manner described above, audio corresponding to the impulse signal is sequentially emitted in the order of a speaker SP1, a speaker SP2, a speaker SP3, a speaker SP4, a speaker SP5, and a speaker SP6.

Then, the test sound that is sequentially emitted from each of the speakers SP1 to SP6 is collected by the microphone MC, and the collected audio is supplied to the microphone amplifier 61 of the connection polarity determination section 6 via the connection terminal 7. The microphone amplifier 61 amplifies the audio signal supplied thereto to a predetermined level and supplies it to an impulse response obtaining section 62.

The impulse response obtaining section 62 converts the audio signal supplied thereto into a digital signal, and obtains impulse response data by performing signal processing corresponding to the test signal, and supplies the impulse response data to a step response obtaining section 63. For example, when a TSP signal is to be used, an audio signal collected by the microphone is subjected to an FFT process, the phase characteristics thereof are corrected, and impulse response data is obtained by performing an inverse FFT process.

The step response obtaining section 63 performs a filtering process on the impulse response data supplied thereto in order to remove DC (Direct Current) components and components close to DC components, and determines the rise point. In the determination of the rise point of the impulse response, a "fall point" is assumed to be a "rise point" by interpreting it as a "rise" in the minus direction. The reason why DC (Direct Current) components and components close to DC components are removed in the manner described above is that DC components and signal components of an ultra-low frequency are noise irrespective of actual response sound of the speaker and errors of device output and greatly affect processing at a subsequent stage.

Next, with respect to the supplied impulse response data, the step response obtaining section 63 forms a data sample waveform in which accumulative addition (integration computation) is performed on impulse response data at the determined rise point that is used as starting point data and subsequent points. This is equivalent to that a substantial step response in which the rise point of the impulse response data is a starting point is determined in calculation.

In the step response obtaining section 63, a section of several tens of steps to several hundreds of steps is assumed to be a "time determination window" on the basis of a change section of an impulse response from the starting point up to a specific "time determination window", for example, from 50 steps to 100 steps, and step response data is computed with respect to this section. As described above, the data sample waveform (step response data) determined in the step response obtaining section 63 is supplied to the area comparison polarity and determination section 64.

The area comparison polarity and determination section 64 sets the rise point of the step response data to a reference value 0 (zero), computes the areas of a region on the positive side and a region on the negative side, which are surrounded by the waveform by the target step response data and the horizontal axis of the reference value 0 (zero), with respect to the waveform by the step response data computed from this rise point up to the length of a specific "time determination window", and determines the sign side having a larger area as a connection polarity of a speaker for which a determination is to be made.

That is, the area comparison polarity and determination section 64 computes the areas of a region on the positive side and a region on the negative side, which are surrounded by the waveform by the step response data and the horizontal axis of the reference value 0 (zero), compares the areas, determines that a "positive connection" is made if the area on the positive side is larger, and determines that a "negative connection" if the area of the region on the negative side is larger. This determination result is reported to the control section 10 and is provided to the user via the LCD 11. As a result of such series of determination processes being sequentially performed for each of the speakers SP1 to SP6, the connection polarity of each of the speakers SP1 to SP6 is determined, and this connection polarity can be reported to the user.

As a result, it is possible for the user to clearly know a speaker that is "negatively connected (reverse connection)" and possible to take swift action, for example, remaking a connection to the power amplifier of the speaker that is "negatively connected (reverse connection)". Moreover, as described above, the connection polarity can be accurately determined on the basis of the area surrounded by the step response data and the reference value 0 (zero), that is, on the basis of the magnitude of the energy of the emitted impulse signal. Therefore, it is not necessary to adjust the position at which the microphone MC for collecting a test signal and the direction thereof one by one on the basis of the position at which each speaker is installed, and the connection polarity of the speaker can be quickly determined.

Figure 3:
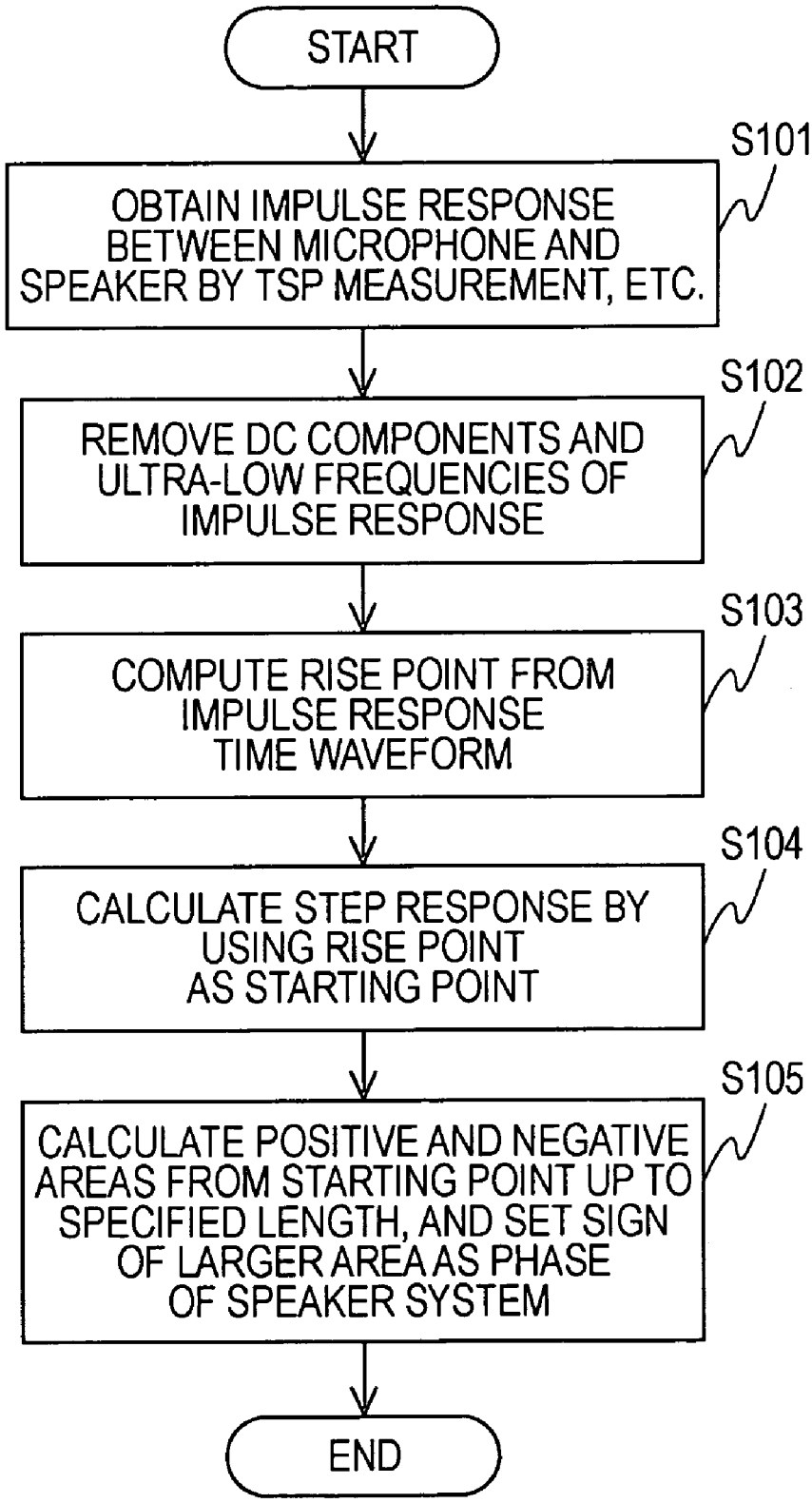
FIG. 3 is a flowchart illustrating an operation of the connection polarity determination section 8 shown in FIG. 2.

Next, a description will be given, with reference to the flowchart in FIG. 3, of the operation of the connection polarity determination section 6. FIG. 3 is a flowchart illustrating processing performed in the connection polarity determination section 6 when a process for determining the connection polarity of the speaker is instructed by the user.

As is also described above, when it is instructed by the user that a process for determining the connection polarity of the speaker be performed, audio corresponding to an impulse signal, which is a test signal, is emitted from the speaker, and this audio is collected by the microphone MC and is supplied to the connection polarity determination section 6. Therefore, the impulse response data between the microphone and the speaker is obtained by the functions of the microphone amplifier 61 and the impulse response obtaining section 62 (step S101). This impulse response data can also be used for analysis for performing the above-described time alignment correction, the frequency characteristics correction, and the gain correction.

The impulse response data obtained via the impulse response obtaining section 62 is supplied to the step response obtaining section 63. The step response obtaining section 63 removes DC components and components close to DC components (step S102) by performing a filtering process on the impulse response data supplied thereto and computes (determines) the rise point of the impulse response (step S103).

The determination as to the rise point of the impulse response can be accurately determined by using the amplitude data of a waveform of only the positive region formed by performing a technique disclosed in, for example, Japanese Patent Application No. 2004-13367, that is, by converting impulse response data into a positive value and by performing filtering using a low-pass filter. Of course, another method may be used.

Next, by using this rise point as starting point data, a data sample waveform is created by performing accumulative addition on the target impulse response data for the length from the starting point that is the target rise point up to the "time determination window" (step S104). This is equivalent to that, as is also described above, a substantial step response in which the rise point is a starting point is determined in calculation.

As described above, after the step response is computed for the length from the starting point up to the specific "time determination window", with respect to the waveform sample value within the determination window, the areas on the positive and negative sides are determined, the sign side having a larger area is determined as a connection polarity (connection phase) of the target connected speaker system, that is, the speaker for which a determination is to be made as to the connection polarity among the speakers SP1 to SP6 (step S105). That is, if the area on the positive side is larger, it is determined that the speaker is positively connected, and if the area on the negative side is larger, it is determined that the speaker is negatively connected.

In the manner described above, without depending on the position of the microphone for collecting a TSP signal, which is a test signal, that is, even when the microphone is kept to be installed at a listening position, the connection polarity of each of the speakers SP1 to SP6 can be accurately and quickly determined.

Here, for the sake of simplicity of concepts, a test signal is emitted from the speaker, and an impulse response is directly collected by the microphone. In practice, by considering the S/N ratio, it is practical and desirable to emit the above-described TSP signal and to determine an impulse response from the TSP response in which the sound collected result is addition averaged via the impulse response computation means.

It is described that, in step S103 in the flowchart shown in FIG. 3, the "rise point" of an impulse response is determined, and in step S104, the "rise point" of the impulse response, which is determined in step S103, is a starting point at which the step response is determined. As is also described above, this means that noise components generated from the first sample of the impulse response data up to the sample of the actual rise are not taken into consideration. For example, even if a step response is determined from the beginning of the impulse response, the subsequent data is handled by setting the "rise point as a starting point", that is, by assuming the value at this point as a reference value 0 (zero), and the positive and negative areas are compared with each other, this is the same in terms of meaning.

It is not always necessary to cause the starting point at which the step response is computed to match the "rise point", and it is of course possible that the computation starting point is adjusted to slightly come in front or behind this rise point by considering an error when the rise point is to be computed.

Furthermore, when the length of the time determination window is to be determined, it is necessary to consider a distance between speaker units for which a determination is to be made as to the connection polarity. For example, when two speaker units of a woofer and a tweeter are incorporated within the same housing, it is necessary to correctly collect each TSP sound, which is a test signal emitted from each of the woofer and the tweeter, and to correctly obtain respective impulse response components.

For example, a speaker including a woofer and a tweeter is considered. In general, when a microphone is placed directly above or directly below the speaker, the difference between the distance from the target microphone to the target woofer and the distance from the target microphone to the target tweeter becomes a maximum. In the manner described above, when the difference between the distances of each speaker unit including a microphone and a speaker for which a determination is to be made as to the connection polarity becomes a maximum, the length of the time determination window may be determined so that all the impulse response components corresponding to test sound from each of the speaker units can be obtained can be obtained.

With respect to the setting of the time determination window, by determining that the beginning portion of the impulse response of each unit is sufficiently contained in the normally intended sound field, the reliability of the determination of the connection polarity can be increased. In practice, it is possible to cause a large number of types of speakers to sound in a practical sound field for the purpose of carrying out studies, and it is possible to appropriately perform parameter setting for the length of the time determination window, etc.

Regarding the length of the determination window, as described above, even when fixed parameter values determined from experiments that are performed in advance are used, the time width may be changed on the basis of a frequency response by, for example, analyzing frequency characteristics and by setting long the time width of the time determination window when it is determined that the speaker system is a 2-way or more-way type and by shortening the time width of the time determination window when the effective band of the speaker is narrow.

In the above-described embodiment, it is described that the removal of DC components and ultra-low frequency components of the impulse response and the specification of the rise point of the impulse response are performed in the step response obtaining section 63, but the embodiment is not limited to this example. Of course, the removal of DC components and ultra-low frequency components of the impulse response and the specification of the rise point of the impulse response may be performed in the impulse response obtaining section 62.

The main point is that test sound emitted from each speaker is collected to correctly obtain the impulse response. By integrating the impulse response, a step response is obtained. The areas of a region on the positive side and a region on the negative side, which are formed by the waveform of the target step response and the horizontal axis of the reference value 0 (zero), are determined. By comparing the area of the region on the positive side with the area of the region on the negative side, the side having a larger area is determined (specified) to be a connection polarity.

[Application to Program]

The functions of the connection polarity determination section 8 of the playback apparatus of the above-described embodiment can also be realized by a program executed in the control section 10. That is, as a result of forming a program for performing processing described with reference to FIG. 3 and as a result of this program being executed in the control section 10, the functions of the connection polarity determination section 8 can also be realized by the control section 10.

The main point is that the CPU constituting the control section 10 of the playback apparatus performs a process for obtaining impulse response data on the basis of a test signal, which is emitted from the speaker and is collected by the microphone, and integrates the obtained impulse response data, thereby computing step response data.

In the determination segment of a predetermined time width in which the rise point of the impulse response is a starting point, if the areas of the respective regions on the positive and negative sides, which are surrounded by a horizontal axis in which a reference value is zero and a waveform of the step response data, are determined, and the connection polarity of the speaker is determined on the basis of their size relationship, the connection polarity determination section can be realized by software without providing it as hardware.

[Experiments for Connection Polarity Determination]

Figure 4:
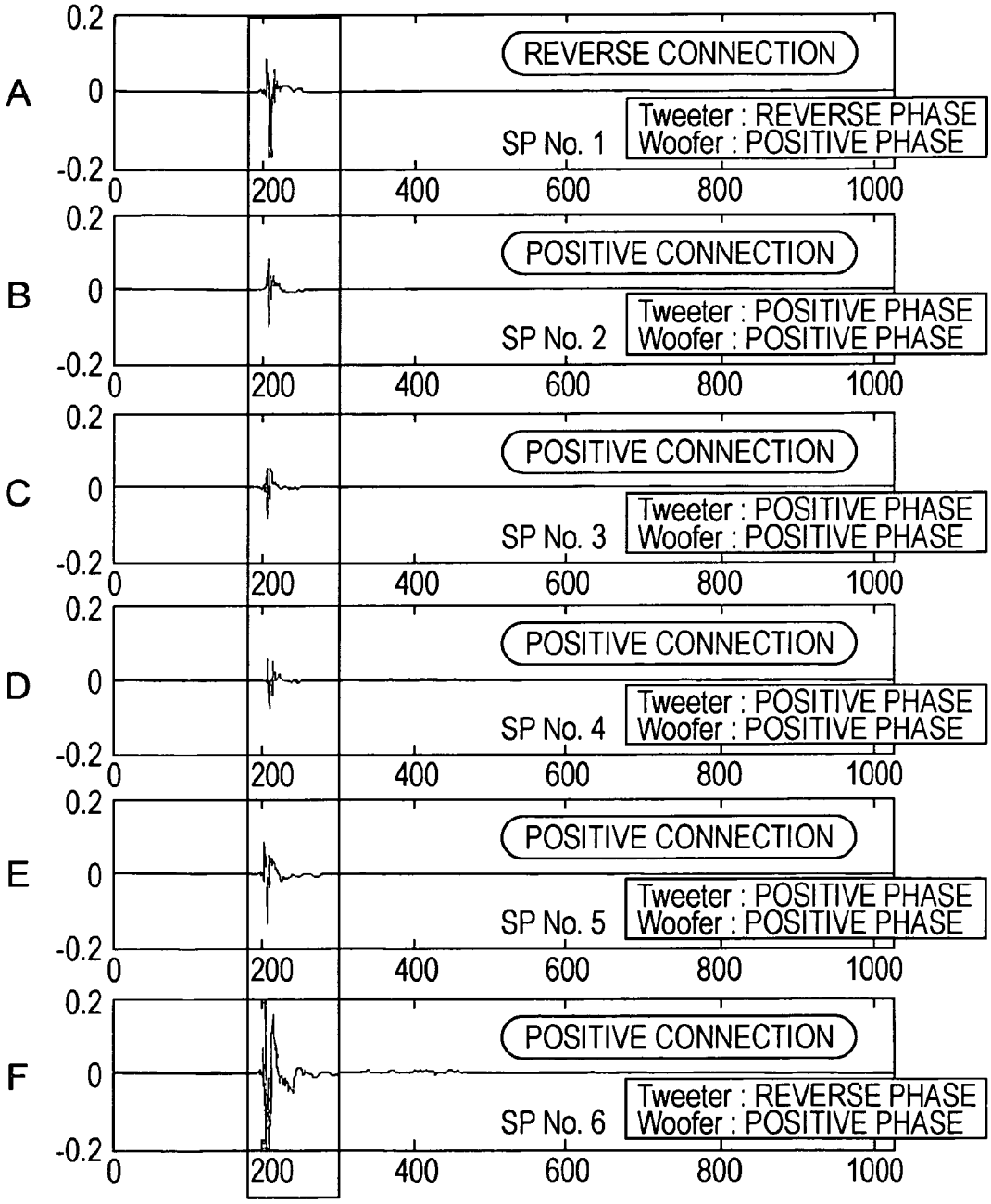
FIG. 4 shows examples of impulse responses with respect to each speaker of a 5.1 channel.

Next, a description will be given by specifically showing experiment data with respect to the connection polarity of each speaker in the playback apparatus of the above-described embodiment. FIG. 4 shows waveforms of impulse response data of each of the speakers SP1 to SP6, in which test sound emitted from each of the speakers SP1 to SP6 of the playback apparatus of the above-described embodiment is collected by the microphone MC, and this test sound is obtained in the connection polarity determination section 8.

Part A of FIG. 4 shows a waveform of an impulse response of the speaker SP1. Part B of FIG. 4 shows a waveform of an impulse response of the speaker SP2. Part C of FIG. 4 shows a waveform of an impulse response of the speaker SP3. Part D of FIG. 4 shows a waveform of an impulse response of the speaker SP4. Part E of FIG. 4 shows a waveform of an impulse response of the speaker SP5. Part F of FIG. 4 shows a waveform of an impulse response of the speaker SP6. SP No. 1, SP No. 2, SP No. 3 SP No. 4, SP No. 5, and SP No. 6, shown in FIG. 4, correspond to the speakers SP1, SP2, and SP3, SP4, SP5, and SP6 of the above-described playback apparatus, respectively.

Figure 5A:
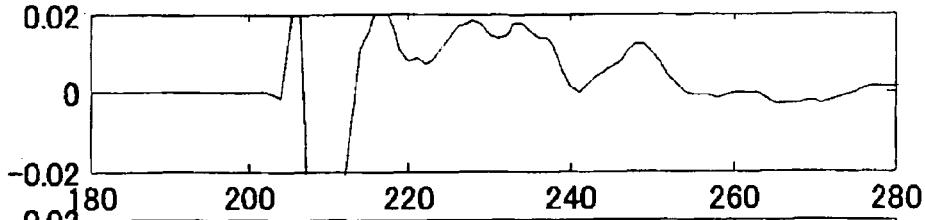
FIGS. 5A, 5B, 5C, 5D, 5E, and 5F show enlarged waveforms of a rise portion of the impulse response shown in FIG. 4.
Figure 5B:
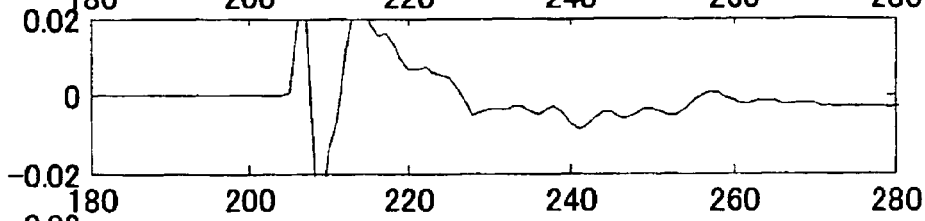
Figure 5C:
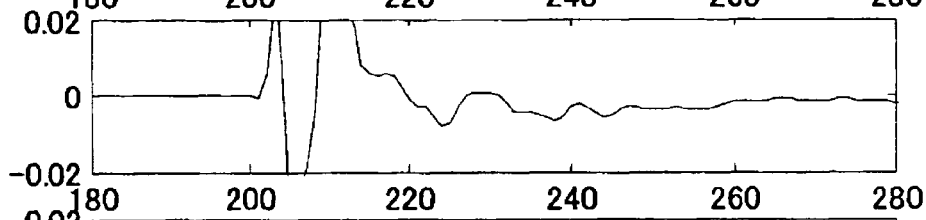
Figure 5D:
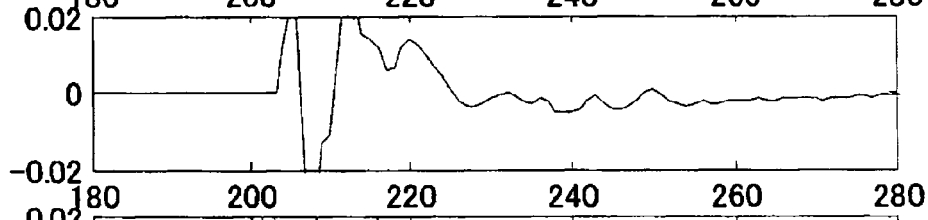
Figure 5E:
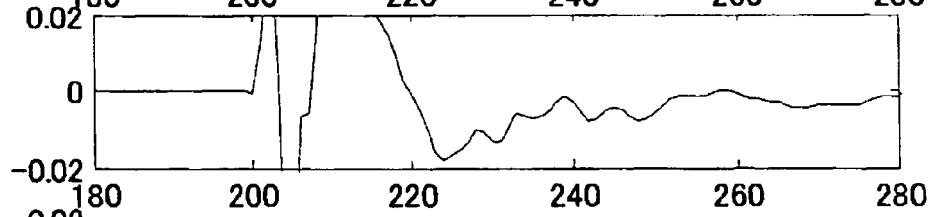
Figure 5F:
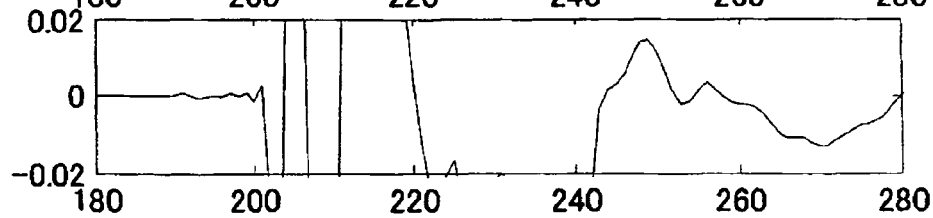

FIGS. 5A to 5F show enlarged waveforms of a rise portion of the impulse response shown in parts A to F of FIG. 4, respectively. That is, FIG. 5A shows a rise portion of the impulse response shown in part A of FIG. 4. FIG. 5B shows a rise portion of the impulse response shown in part B of FIG. 4. FIG. 5C shows a rise portion of the impulse response shown in part C of FIG. 4. FIG. 5D shows a rise portion of the impulse response shown in part D of FIG. 4. FIG. 5E shows a rise portion of the impulse response shown in part E of FIG. 4. FIG. 5F shows a rise portion of the impulse response shown in part F of FIG. 4.

Figure 6:
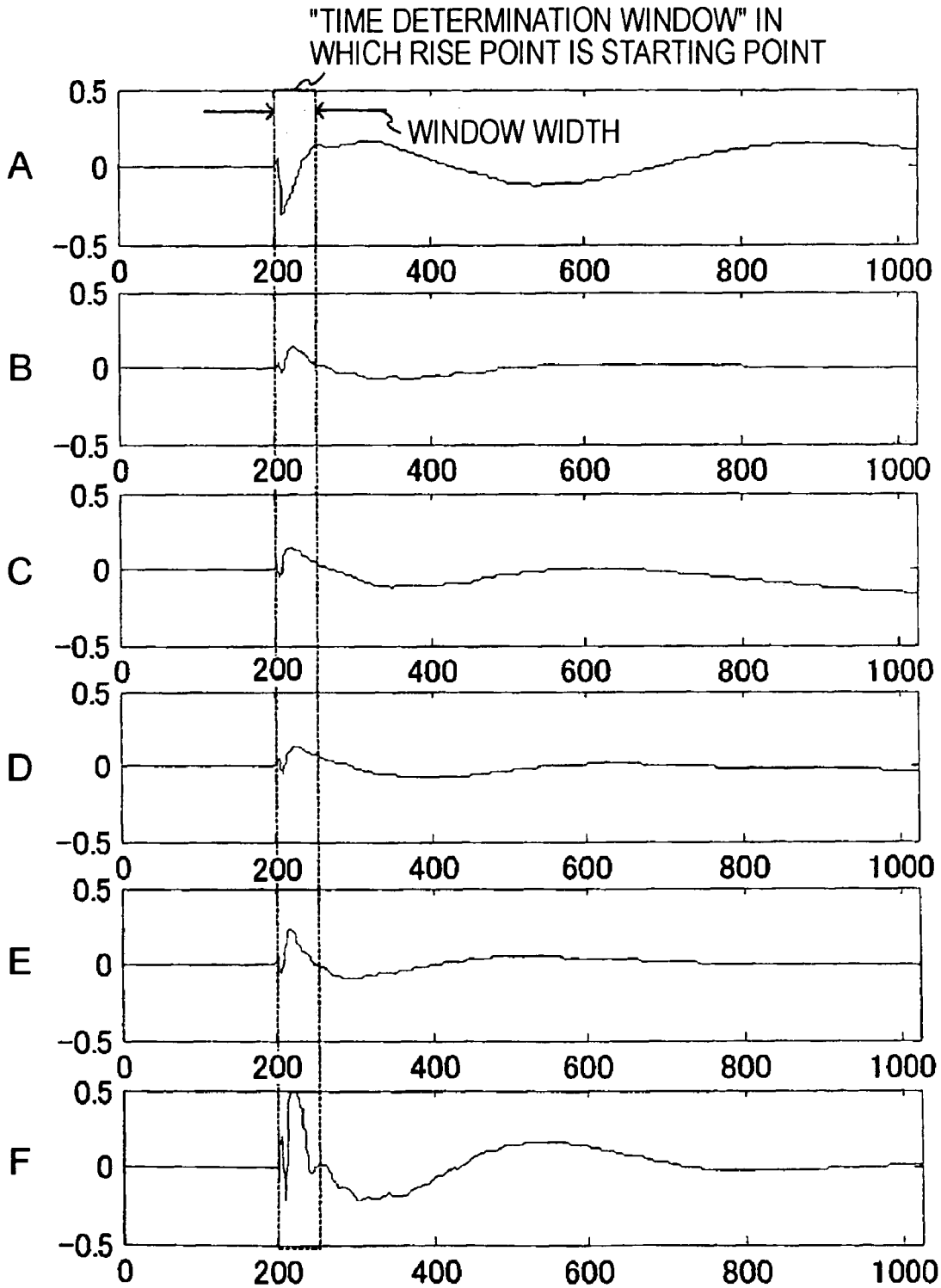
FIG. 6 shows examples of step responses determined from the impulse responses shown in FIG. 4.

FIG. 6 shows waveforms of step responses obtained by integrating the impulse response of each of the speakers SP1 to SP6 shown in FIG. 4. That is, part A of FIG. 6 shows a waveform of a step response determined from the impulse response shown in part A of FIG. 4. Part B of FIG. 6 shows a waveform of a step response determined from the impulse response shown in part B of FIG. 4. Part C of FIG. 6 shows a waveform of a step response determined from the impulse response shown in part C of FIG. 4. Part D of FIG. 6 shows a waveform of a step response determined from the impulse response shown in part D of FIG. 4. Part E of FIG. 6 shows a waveform of a step response determined from the impulse response shown in part E of FIG. 4. Part F of FIG. 6 shows a waveform of a step response determined from the impulse response shown in part F of FIG. 4.

As shown on the right side of parts A to F of FIG. 4 by being surrounded by a rectangle for the purpose of being capable of correctly confirming the effectiveness of the determination of the connection polarity, each of the speakers SP1 to SP6 includes two speaker units of a tweeter and a woofer, and only the tweeter units of the speakers SP1 and SP6, which are reversely connected in the inside, are used. The microphone MC is kept to be placed at a listening position selected by the user.

The waveforms of impulse responses obtained by performing experiments when the connection polarity of only the speaker SP1 was reversely connected are waveforms shown in parts A to F of FIG. 4. It can be confirmed from the waveforms shown in parts A to F of FIG. 4 that an impulse response corresponding to each test signal emitted from each of the speakers SP1 to SP6 could be correctly obtained. Then, the enlarged waveforms of the rise portions of each impulse response of parts A to F of FIG. 4, shown in FIGS. 5A to 5F, are confirmed.

The polarity of the value of the rise portion of the impulse response with respect to the speaker SP1 shown in FIG. 5A is in the "positive direction" in spite of the fact that a reverse connection is forcibly made in the manner described above. The polarity of the value of the rise portion of the impulse response with respect to the speakers SP2 to SP5 shown in FIGS. 5B to 5E is "positive". The polarity of the value of the rise portion of the impulse response with respect to the speaker SP6 shown in FIG. 5F is "negative" in spite of being a positive connection.

As described above, if a determination is to be made as to the connection polarity of each speaker on the basis of only the polarity of the rise portion of the impulse response, in the case of this example, an erroneous determination is made in the speakers SP1 and SP6.

Therefore, as shown in parts A to F of FIG. 6, step responses are determined from the impulse responses with respect to the speakers SP1 to SP6 shown in parts A to F of FIG. 4. In a predetermined "time determination window", areas of a positive side region (region higher than the reference value 0 (zero)) and a negative side region (region lower than the reference value 0 (zero)), which are surrounded by a waveform of the step response and the horizontal axis of the reference value 0 (zero), are determined, and the connection polarity of the speaker is determined on the basis of their size relationship.

Figure 7A:
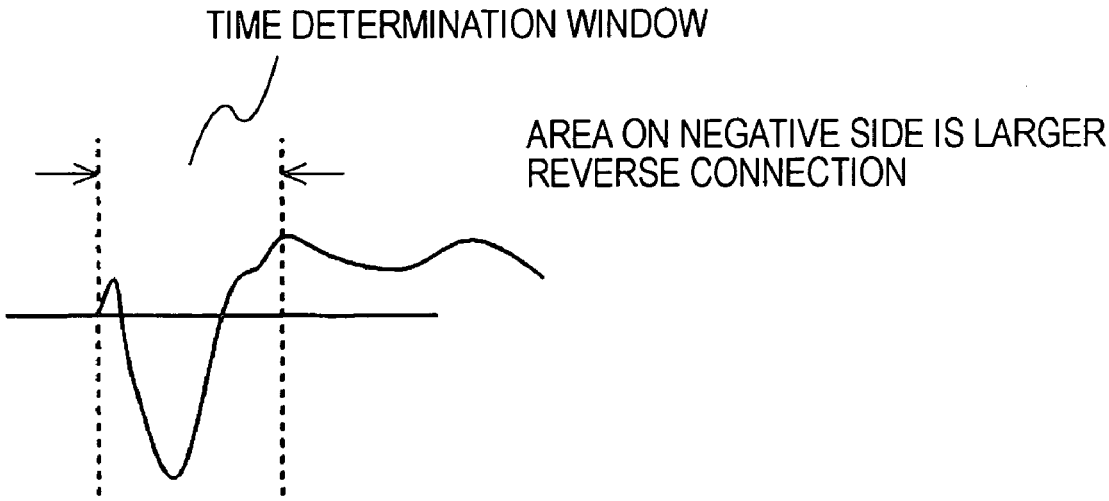
FIGS. 7A and 7B show enlarged waveforms of a time determination window part of the step response shown in parts A and B of FIG. 6.
Figure 7B:
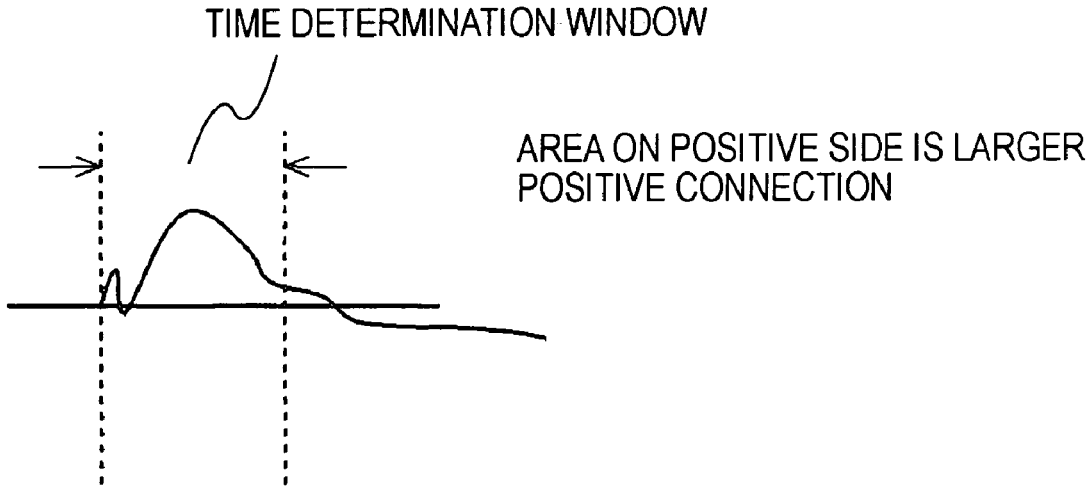
Figure 8:
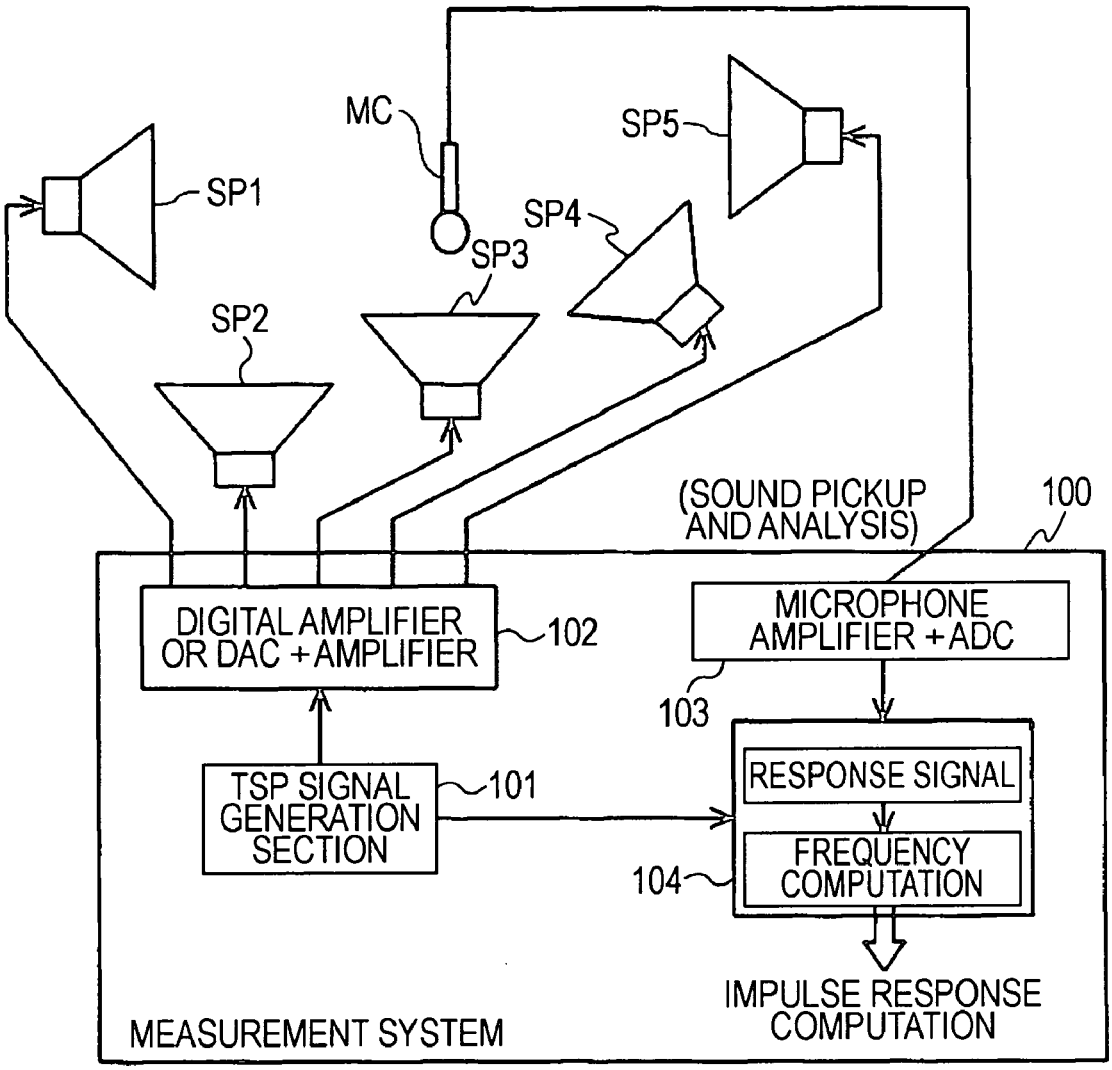
FIG. 8 illustrates an example of a measurement system capable of performing polarity determination in association with a connection of a speaker of the related art.

FIG. 7A shows an enlarged waveform of a time determination window part of the step response of FIG. 6A. FIG. 7B shows an enlarged waveform of a time determination window part of the step response of FIG. 6B. As shown in FIG. 7A, in a predetermined time determination window part of the step response determined by accumulatively adding (integrating) the impulse response with respect to the speaker SP1, the step response is changed greatly toward the negative side. It can be seen that, with respect to the areas of the regions surrounded by the waveform of the impulse response and the horizontal axis of the reference value 0 (zero), the area of the region on the negative side is larger.

As described above, when the area of the region on the negative side is larger, it can be seen that the connection polarity of the target speaker is in a negative connection (reverse connection). That is, as is also described above, the connection polarity with respect to the speaker SP1 that is determined as "in a negative connection (reverse connection)" can be accurately determined.

As shown in FIG. 7B, in a predetermined time determination window part of the step response determined by accumulatively adding (integrating) the impulse response with respect to the speaker SP2, the step response is changed greatly toward the positive side. It can be seen that the area of the region, which is surrounded by the waveform of the impulse response and the horizontal axis of the reference value 0 (zero). As described above, it can be determined that, when the area of the region on the positive side is larger, the connection polarity of the target speaker is in a positive connection.

As can also be seen by viewing the time determination window part of the step responses shown in parts B, C, D, E, and F of FIG. 6, in the time determination window parts of the step responses shown in parts B, C, D, E, and F of FIG. 6, with respect to the region surrounded by the waveform of the step response and the horizontal axis of the reference value 0 (zero), it can be seen that the area of the region on the positive side is clearly larger and that the connection polarity of each of the speakers SP1 to SP6 corresponding to the waveforms of these step responses is "in a positive connection".

Therefore, as is also described above, in the determination based on the polarity of the rise portion of the impulse response, it is possible to accurately determine that, also with respect to the speaker SP6 in which a negative connection (reverse connection) is made, it can be accurately determined that the connection polarity is "in a positive connection".

As can be seen by viewing the waveforms of the step responses of each speaker shown in FIG. 6, when these waveforms are observed for a long time, the difference between the positive and negative areas becomes smaller. Therefore, as is also described above, it is important to observe the waveforms in a range of a "time determination window" of a correct time width, which is formed at a correct position.

The main points of the apparatus, the method, and the recording medium according to embodiments of the present invention can be summarized as follows:

(1) An impulse response between a microphone and a speaker, which are installed by the user, is determined by a TSP measurement, etc., and step response data is computed internally from the data.

(2) With respect to the step response waveform, a time window for determination in which the rise point of the impulse response is a starting point is taken note of, and analysis and determination are performed.

(3) The analysis is performed in such a manner that, with respect to the step response in which a sample value that becomes a starting point is newly set to zero, within a specific time window, the respective areas of the waveform on the positive and negative sides are determined, and a sign having a larger area is determined to be the polarity of the speaker.

As described above, as a result of satisfying all the points (1), (2), and (3), as is also described above, it is possible to accurately and quickly determine the connection polarity of each speaker without depending on the position of the microphone.

In the above-described playback apparatus, a description is given by assuming that the determination result of the connection polarity with respect to each speaker is provided to the user via the LCD 11 so as to prompt for connection confirmation, but the embodiment is not limited to this example. A voice message, such as "Please confirm the plus and minus connections", may be emitted from, for example, a speaker whose connection polarity is determined to be in a reverse connection. In this case, for example, it may need only to allow only the audio channel to which a speaker targeted by the test audio generation section 6 is connected to generate and send a voice message in accordance with the control of the control section 10.

With respect to the audio channel to which a speaker that is determined in a reverse connection on the basis of the determination result of the connection polarity, inside the signal processing section, such as the sound field correction section 3 and the power amplifier 5, a signal inversion process (process for inverting the polarity of a signal) may be performed in an internal manner. Since the signal inversion process in this case may need only to be performed at a stage prior to the speaker determined to be in a reverse connection, it can be dealt with by providing a signal inversion section or a circuit in any portion at a stage prior to the speaker and by allowing this to be controlled by the control section 10, etc.

On the basis of the connection polarity determination result, in order that, for example, the speaker of the front right channel and the speaker of the front left channel, on which importance is given, have the same connection polarity, with respect to an audio signal of the audio channel to which the speaker that is determined to be in a negative connection, a signal inversion process (process for inverting the polarity of a signal) may be performed in an internal manner may be performed inside the signal processing section, such as the sound field correction section 3 and the power amplifier 5, so that both the connection polarities of the speakers in a pair may become of a positive connection.

In this case, with respect to the audio signal of the audio channel to which the speaker that is determined to be in a positive connection, a signal inversion process may be performed internally inside the signal processing section, such as the sound field correction section 3 and the power amplifier 5, so that both the connection polarities of the speakers in a pair may become of a negative connection. The main point is that a signal inversion process may need only to be performed so that the connection polarities become the same between speakers that become an important pair in order to form a correct sound field.

In the above-described embodiment, the connection polarity is determined by using, for example, a TSP measurement signal, but this embodiment is not limited to this example. If an impulse response can be determined, of course, a signal other than a TSP measurement signal may be used for the measurement signal.

Furthermore, the determination of the connection polarity of each speaker and the process for forming a parameter for sound field correction may be performed at the same time. Alternatively, the determination of the connection polarity of each speaker and the process for forming a parameter for sound field correction can also be separately performed at appropriate timings.

In the measurement process for forming a parameter for sound field correction, as disclosed in Japanese Patent Application No. 2004-13367, it is possible to compute a distance for time alignment from an impulse response waveform (time waveform). On the other hand, it is possible to form a parameter for correcting the frequency of a speaker on the basis of a frequency response determined by performing FFT on an impulse response.

A description has been given by using as an example a case in which the present invention is applied to a multi-channel playback apparatus of a 5.1 channel, but the present invention is not limited to this example. The present invention can be applied to a multi-channel system of various number of channels, such as a 7.1 channel and a 9.1 channel, and to a one-channel speaker. Furthermore, the present invention can be applied to a case in which manufacturing steps are checked and the polarity during connection and wiring is checked in an array speaker formed of as much as several tens and several hundreds of speaker devices.

As is also described above, as can be seen from the fact that the step response is obtained by integrating an impulse response, in the apparatus, the method, and the recording medium according to the above-described embodiments, a determination is made as to the phase polarity of a low frequency (woofer band). Therefore, in the case of a speaker system in which the woofer unit is in a reverse phase in an internal manner, even if the connection polarity is of a positive connection, there are cases in which it is determined as a reverse connection. However, in most standard speakers at present, the woofer side is in a positive connection, and few problems occur.

By considering the fact that a speaker system in which a woofer unit is internally in a reverse phase exists, a check is made to determine whether or not the connection polarity differs between, for example, speakers in a pair, such as a left speaker and a right speaker. When both the connection polarities of the speakers in a pair are in a negative connection, it is possible to request a user to confirm the internal connection by consulting an instruction manual of the speaker by using a message displayed on an LCD and a voice message.

As described above, obtainment of a step response of the speaker corresponds to a response when DC components are suddenly input to a speaker with no input. This is close to the fact that, in a manufacturing site or in a usage site, a speaker engineer connects a battery to a speaker terminal and checks the polarity by viewing the direction in which the cone of the speaker is moved.

However, when DC components are actually fed into the speaker, there are cases in which a coil is broken due to heat, and a vibration plate is displaced more than specified and the speaker is damaged. In the case of an embodiment of the present invention, a measurement signal, such as a TSP measurement signal, having no danger of damaging a speaker, is input and an impulse response is determined, and thereafter a step response is calculated in a simulation manner. Therefore, there is no risk of deteriorating the speaker and there are merits being safe.

Furthermore, in a multi-channel environment, a plurality of types of speakers are used. For example, when a positive connection and a reverse connection with respect to connections inside a woofer speaker system coexist, it is important to detect the difference between them, and to point out it to a user or to perform phase correction inside system equipment. The present invention is very effective in: the meaning that, in particular, since a difference in phase from the viewpoint of a sense of listening appears in low frequencies, the difference in the polarity of the woofer band can be correctly pointed out.

It should be understood by those skilled in the art that various modifications, combinations, sub-combinations and alterations may occur depending on design requirements and other factors insofar as they are within the scope of the appended claims or the equivalents thereof.

The invention claimed is:

1. An acoustic apparatus, comprising:

obtaining means for obtaining impulse response data between at least one speaker and a microphone;

computation means for computing step response data by integrating the impulse response data obtained by the obtaining-means; and determination means for determining a connection polarity of the speaker in accordance with the size relationship of areas of a region on the positive side and a region on the negative side of the step response data in a determination segment of a predetermined time width in which a rise point of the step response is a starting point.

2. An acoustic apparatus according to claim 1, further comprising:

signal generation means for generating a test signal for measuring the impulse response;

an output amplifier for supplying the test signal to the speaker; and an input amplifier for supplying an output signal of the microphone for collecting the test signal emitted from the speaker to the obtaining means.

3. The acoustic apparatus according to claim 1, further comprising output means for outputting a determination result in the determination means.

4. The acoustic apparatus according to claim 1, further comprising signal inversion means for inverting the polarity of an audio signal to be supplied to the speaker when the determination result in the determination means indicates a negative connection.

5. The acoustic apparatus according to claim 1, further comprising:

determination means for determining whether the determination results of the connection polarities of speakers used in a pair in the determination means differ from each other; and signal inversion means for inverting the polarity of an audio signal of an audio channel connected to one of the pair of speakers when it is determined by the determination means that the determination results differ from each other.

6. A connection polarity determination method comprising:

obtaining impulse response data between at least one speaker and a microphone;

computing step response data by integrating the obtained impulse response data; and determining a connection polarity of the speaker in accordance with the size relationship of areas of a region on the positive side and a region on the negative side of the step response data in a determination segment of a predetermined time width in which a rise point of the step response is a starting point.

7. A recording medium having stored thereon a connection polarity determination program for enabling a computer installed in an acoustic apparatus to perform a process for determining connection polarity, the process comprising:

obtaining impulse response data between at least one speaker and a microphone;

computing step response data by integrating the impulse response data obtained in the obtaining step; and determining a connection polarity of the speaker in accordance with the size relationship of areas of a region on the positive side and a region on the negative side of the step response data in a determination segment of a predetermined time width in which a rise point of the step response is a starting point.

8. An acoustic apparatus, comprising:

an obtaining section configured to obtain impulse response data between at least one speaker and a microphone;

a computation section configured to compute step response data by integrating the impulse response data obtained by the obtaining section; and a determination section configured to determine a connection polarity of the speaker in accordance with the size relationship of areas of a region on the positive side and a region on the negative side of the step response data in a determination segment of a predetermined time width in which a rise point of the step response is a starting point.

* * * * *